United States Patent [19]

Grassmann

[11] 4,218,830

[45] Aug. 26, 1980

[54] DEVICE FOR DRYING THE SIZING OF SPUN GLASS FILAMENTS OR THE LIKE

[75] Inventor: Hans-Christian Grassmann, Igelsdorf, Fed. Rep. of Germany

[73] Assignee: Siemens Aktiengesellschaft, Berlin and Munich, Fed. Rep. of Germany

[21] Appl. No.: 943,303

[22] Filed: Sep. 18, 1978

[30] Foreign Application Priority Data

Sep. 19, 1977 [DE] Fed. Rep. of Germany ..... 2742086

[51] Int. Cl.[2] ..... F26B 3/34

[52] U.S. Cl. ..... 34/1; 34/68; 34/229; 219/10.61 R; 219/10.81; 219/343

[58] Field of Search ..... 34/1, 68, 18, 222, 229; 219/10.61 R, 10.67, 10.69, 10.81, 343

[56] References Cited

U.S. PATENT DOCUMENTS

| | | | |
|---|---|---|---|
| 3,740,257 | 6/1973 | Roscher | 34/1 |
| 3,953,701 | 4/1976 | Manwaring | 219/10.81 |
| 3,979,836 | 9/1976 | Grassman | 34/1 |
| 4,014,732 | 3/1977 | Beckert et al. | 34/1 |
| 4,048,917 | 9/1977 | Skrypek et al. | 210/343 |

FOREIGN PATENT DOCUMENTS

| | | |
|---|---|---|
| 2220520 | 11/1973 | Fed. Rep. of Germany . |
| 2041557 | 12/1975 | Fed. Rep. of Germany . |

*Primary Examiner*—Larry I. Schwartz
*Attorney, Agent, or Firm*—Kenyon & Kenyon

[57] ABSTRACT

The invention relates to a device for drying the sizing of spun glass filaments by high frequency heating during the winding operation. To promote drying, the electrodes next to the roll are enclosed by housings into which hot air is blown.

2 Claims, 2 Drawing Figures

DEVICE FOR DRYING THE SIZING OF SPUN GLASS FILAMENTS OR THE LIKE

BACKGROUND OF THE INVENTION

This invention relates to a device for drying the sizing of spun glass filaments wound into a coil or roll on winding machines, there being a number of electrodes of alternating potential disposed about the roll transverse to the longitudinal direction of travel of the filaments onto the roll and in which means are provided for controlling the spacing of the electrodes from the coil surface and the level of electric power applied to them.

An arrangement of this kind for drying filaments is described, for instance, in German Pat. No. 2,041,557. A positioning device by means of which the electrodes can be adjusted relative to each other and relative to the coil surface is described in greater detail in the German Offenlegungsschrift No.2,220,520, which is a supplement to the patent just mentioned.

From a technical and economic point of view, drying devices of the above-described type have proven successful for the drying of filaments and, where applicable, of textile webs, as well.

However, now as before, droplets spun off in the winding operation and vapor clouds emitted as a result of the drying effect represent a continuing problem because they may induce electrical sparkover at the electrodes. This problem cannot be avoided by simply adding a predrying operation.

It is an object of the present invention to provide a device of the type described above in which the drying process is enhanced and the danger of electrical sparkovers at the electrodes reduced.

BRIEF SUMMARY OF THE INVENTION

According to the invention, this problem is solved by enclosing the electrodes in a housing which extends close to the surface of the roll and opens onto it, being separated by a gap. Hot air at more than 100° C. is blown under pressure onto the surface through the housing and the gap.

In this manner, drying of the coil is enhanced and, at the same time, both droplets and vapors are carried away through the gap by the flow of hot air so that neither moisture nor sizing can precipitate on the electrodes. Use of this arrangement also results in the electrodes themselves reaching a higher temperature because the evaporation of any condensation from the electrodes is eliminated.

Structurally, the housing advantageously consists of a number of individual chambers interconnected, as by hinges, each chamber covering one group of electrodes. Means are provided for adjusting housing and electrode placement jointly as the roll diameter changes.

Each chamber is preferably provided with a separate hot air supply line; it also is possible to feed the hot air into the chambers through holes in the electrodes.

DETAILED DESCRIPTION OF THE INVENTION

Figure 1:
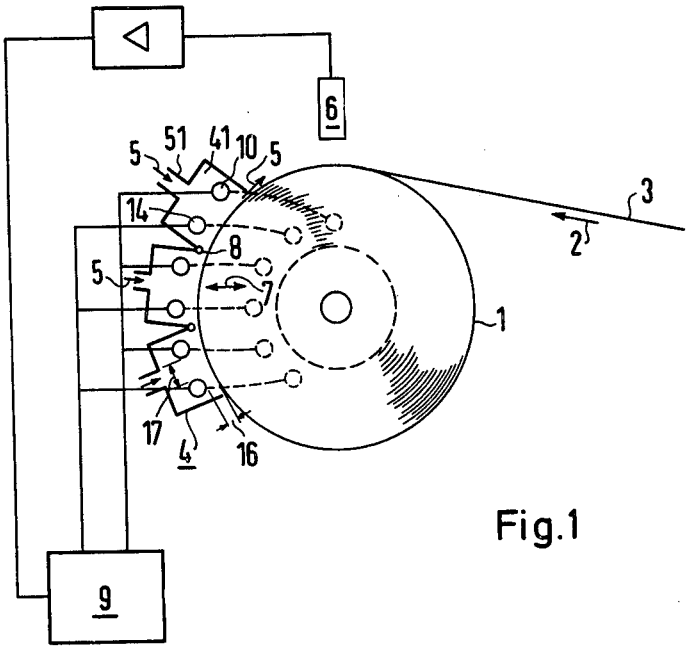
FIG. 1 is a side view of an embodiment of the invention schematically illustrating its principles.

As shown in FIG. 1, the filament 3, impregnated with sizing and consisting of a multiplicity of individual fibers, runs toward the winding machine in the direction of arrow 2, and is wound there into a roll or coil 1. A multiplicity of rod-like electrodes 10 and 14 is distributed above the circumference of roll 1 and oriented transversely to the longitudinal direction of travel of the filament 3. The electrodes 10 and 14 extend the full axial length of roll 1 and are connected in alternation to the separate output terminals or poles of the high frequency source 9; the electrodes are adjustable both relative to each other and, in the direction of the double arrow 17, relative to the surface of roll 1. Controllable intense drying of the filament 3 is achieved by means of an electric field developed in the direction of the longitudinal filament between the rod-type electrodes 10 and 14. The recommended field strength is between 0.5 to 5 kilovolts per centimeter at a frequency of between approximately 10 MHz and 30 MHz, with 15 MHz being preferred.

The output power of the high frequency source 9 is controlled in response to the temperature picked up by a temperature sensor 6 located near roll 1. The electrodes 10 and 14 are enclosed by a housing 4 which consists of a number of individual chambers 41 interconnected in the manner of hinges at 8; each chamber covers one electrode group 10, 14.

Each chamber 41 is connected to a separate hot air supply line 51 through which hot air 5, at a temperature of more than 100° C., is blown in under pressure, e.g., 1.5 atmospheres. The hot air 5 then flows around the electrodes 10 and 14 and is discharged through the gap between the chamber 41 and the surface of the roll 1. The hot air not only heats the electrodes, but also prevents moisture and sizing from getting to them. Thus additional drying effect is obtained at the roll surface at the same time.

Figure 2:
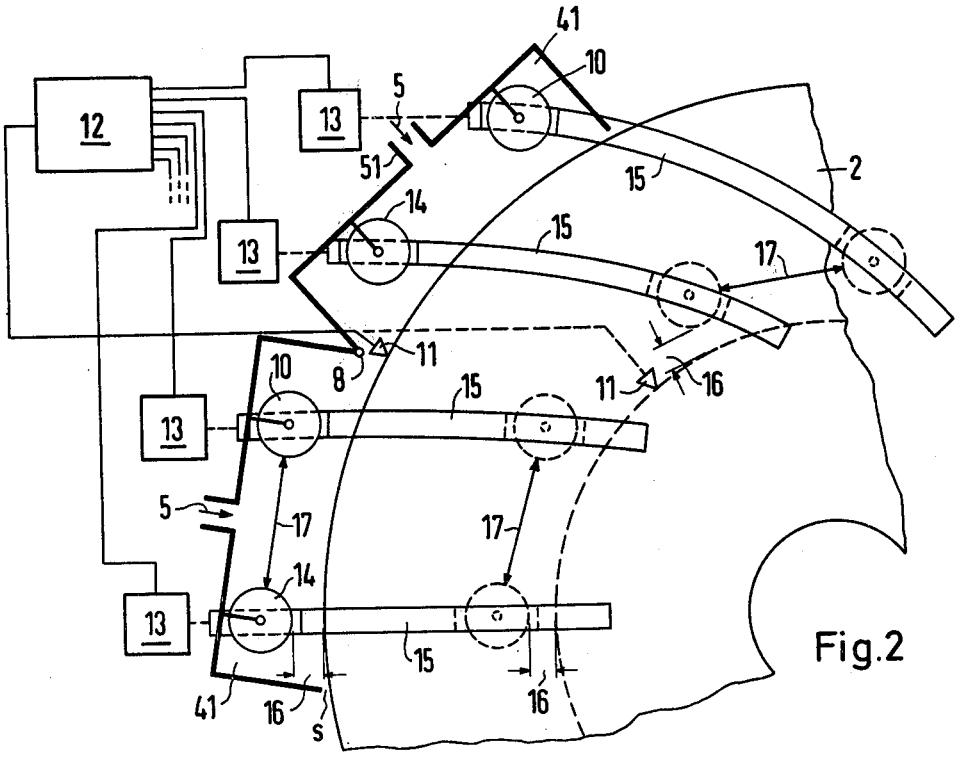
FIG. 2 is an enlarged view of a portion of FIG. 1 showing details of the adjusting mechanism.

As may be seen more particularly in FIG. 2, a sensor 11 acting upon a central control unit 12 is provided for sensing the diameter of the roll 1. The central control unit 12 gives control commands to the individual drives 13 which move the individual electrodes 10 and 14 along the curved or straight guide paths 15 so that their spacing 16 from the surface of roll 1 and their mutual spacing 17 always remain the same or at least approximately the same. This also causes the gaps or spaces between the surface of roll 1 and the chambers 41 mechanically connected to the electrodes to remain approximately constant so that the hot air with the moisture components can escape through the gaps.

The housings themselves are made of a pliable insulating material so as to enable them to follow the electrode motions within certain limits and at the same time to provide electrical insulation between the various electrodes of differenct potential. The arrangement described above may not only be used to dry the sizing of spun glass filaments, but can also be applied, for example, to the drying of textile fibers or the like.

What is claimed is:

1. Apparatus for drying the sizing of spun glass filaments being wound onto rolls comprising:

groups of electrodes adapted for use with an alternating potential and disposed about a roll transversely to the direction of a filament being wound onto the roll;

a housing having chambers, each of which is associated with each group of electrodes and which extends towards the roll so as to enclose the electrodes, each chamber being open towards the roll and having a gap between itself and the roll, while being hingedly joined to at least one adjacent chamber;

a separate line for blowing hot air at more than 100° C. into each chamber;

means for jointly moving each chamber and the associated electrode group to control the spacing of the electrodes from the surface of the roll, whereby the spacing of the housing from the surface of the roll follows the spacing of the electrodes; and means for controlling the power supplied to the electrodes.

2. The apparatus according to claim 1 further comprising means for introducing hot air into the housing through the electrodes.

* * * * *